US007249728B2

(12) United States Patent
Williamson

(10) Patent No.: US 7,249,728 B2
(45) Date of Patent: Jul. 31, 2007

(54) WEAR SURFACE COVER CLIP

(76) Inventor: Keelyn Williamson, 992 S. Kihei Rd. #A101, Kihei, HI (US) 96753

( * ) Notice: Subject to any disclaimer, the term of this patent is extended or adjusted under 35 U.S.C. 154(b) by 355 days.

(21) Appl. No.: 11/055,286

(22) Filed: Feb. 9, 2005

(65) Prior Publication Data

US 2006/0175461 A1 Aug. 10, 2006

(51) Int. Cl.
*B65H 23/00* (2006.01)

(52) U.S. Cl. ..... 242/566; 242/615; 242/397; 242/548; 24/563

(58) Field of Classification Search ..... 242/566, 242/588.3, 615, 615.4, 548, 548.3, 397, 615.21, 242/129, 157 R; 24/295, 545, 555, 563
See application file for complete search history.

(56) References Cited

U.S. PATENT DOCUMENTS

| | | | | |
|---|---|---|---|---|
| 2,683,000 | A | 7/1954 | Beiderwell | |
| 3,589,634 | A * | 6/1971 | Mason | 242/588.1 |
| 4,947,524 | A * | 8/1990 | Chang | 24/67.9 |
| 5,086,988 | A * | 2/1992 | LaPoint et al. | 242/395 |
| 5,309,605 | A * | 5/1994 | Sato | 24/67.9 |
| 5,639,049 | A * | 6/1997 | Jennings et al. | 248/74.2 |
| 5,806,147 | A * | 9/1998 | Sato | 24/67.9 |
| 6,973,700 | B2 * | 12/2005 | Hsiao | 24/67.9 |

* cited by examiner

*Primary Examiner*—Gene O. Crawford
*Assistant Examiner*—Sang Kim
(74) *Attorney, Agent, or Firm*—James E. Brunton, Esq.

(57) ABSTRACT

A novel wear surface cover clip for use with a conventional wire dispensing reel of the type used for dispensing tie wire such as that used for tying rebar during concrete construction projects. The wear surface cover clip of the invention can be easily removably interconnected with a conventional wire dispensing reel and when once installed, markedly extends the life of the wire dispensing reel.

16 Claims, 2 Drawing Sheets

WEAR SURFACE COVER CLIP

BACKGROUND OF THE INVENTION

1.Field of the Invention

The present invention relates generally to tools for dispensing wire. More particularly, the invention concerns a novel wear surface cover clip for covering the wear surfaces of a wire dispensing reel for dispensing tie wire used for tying rebar.

2.Discussion of the Prior Art

During construction and before pouring concrete into the concrete forms, an array of reinforcement bars, commonly known as rebar, are erected within the forms so that when the concrete is poured, the resultant structure is strengthened by the rebar. Traditionally, intersecting sections of rebar are tied together by hand with a malleable wire known as rebar wire.

During the rebar wiring process, it is common practice for the worker to continuously pull the rebar wire from a coil of wire on a reel contained within a hollow housing in a manner such that the end of the wire never leaves the hand of the worker. For example, a worker tying up a rebar slab may completely use a coil of wire without ever letting go of the pulled end of the wire.

Often, the wire dispensing reels are provided with belt receiving loops so that the reels can be mounted upon the belts of the workman so that the wire can be conveniently withdrawn from the wire coils mounted therewithin by pulling the wire out of the casing through one or more openings formed in the casing wall. Typically, the edges of the openings in the casing wall are provided with curved wear surfaces over which the wire passes as it is drawn from the dispensing reel.

As the wire is continuously removed from the reel and passes over the wear surfaces, it will tend to cause severe wear to the wear surfaces and eventually will cut one or more grooves therein of the character shown in FIG. 1. When the wire falls into one of these grooves during the rebar tying operation, the worker will experience binding as a result of the wire being pulled at an angle in a very tight groove as the worker ties from left to right. Further, as the wire is pulled from the coil, it normally tends to travel back and forth over the wear surface of the dispensing reel so that when the wire falls into a groove in the wear surface, severe binding occurs.

Tie wire used in construction typically comes in three gauges, 16.5 gauge (thinnest) used for tying smaller rebar and for 15 gauge (heavy) for tying large and heavy rebar. Tie Wire is packaged and delivered in quantity usually in heavy cardboard boxes with some type of rust inhibitor protection. Often a worker will open a box to find the coils either heavily coated in oil, completely dry or in a progressively rusted state. Experience has shown that whatever the condition of the wire, it has adverse affects on the wear surface of the tie wire dispenser with the rust acting as an abrasive addition to the wire and the oil acting as a cutting fluid.

Further contributing to the wear problems of the prior art wire dispensing reels are the materials used in the manufacture of the wire reels. Such materials range from plastic to untreated steel to sand cast aluminum all of which are well below the hardness of the malleable tie wire. As will be discussed hereinafter, the wear surface cover clip of the present invention is advantageously constructed from stainless steel because it is of its hardness, availability, cost and ease of manuafacture. However, other alloys and carbon compositions of appropriate hardness can also be used to construct the cover clip. For example, galvanized sheet metal has also proven to be acceptable.

Dispensing reels of various construction are readily commercially available from a number of sources, including Klein Tools of Skokie, Ill., and Don De Christo Concrete Accessories, Inc. of Westminster, Calif. A dispensing reel for tie wires is also disclosed in U.S. Pat. No. 2,683,000 issued to its Belderwell. Reference should be made to this patent for a discussion of the construction and operation of dispensing reels of the character with which the wear surface cover clip of the present invention can be used.

SUMMARY OF THE INVENTION

It is an object of the present invention to provide a novel wear surface cover clip for use with a conventional wire dispensing reel of the type used for dispensing tie wire such as that used for tying rebar during concrete construction projects. More particularly, is an object of the invention to provide a wear surface cover clip that can be easily removably interconnected with a conventional wire dispensing reel and when once installed, markedly extends the life of the wire dispensing reel.

It is another object of the invention to provide a wear surface cover clip of the aforementioned character that is usable with most commercially available tie wire dispensing reels.

It is another object of the invention to provide a wear surface cover clip as described in the preceding paragraphs in which the cover clip is provided with a wear surface that substantially covers the wear surface of the wire dispensing reel.

Another object of the invention is provide a wear surface cover clip as described in the preceding paragraph that is constructed from a hardened steel or like material that effectively withstands abrasion resulting from the tie wire passing over the wear surface of the clip.

It is another object of the invention to provide a cover clip of the character described that can be used either with new or used tie wire dispensing reels.

Another object of the invention is to provide a novel wear surface cover clip that is easy to install and one which remains firmly in place once attached to the wire dispensing reel.

Another object of the invention is to provide a wear surface cover clip of the type described in the preceding paragraphs which is of simple construction and one which can be inexpensively manufactured in quantity.

DESCRIPTION OF THE INVENTION

Figure 1:
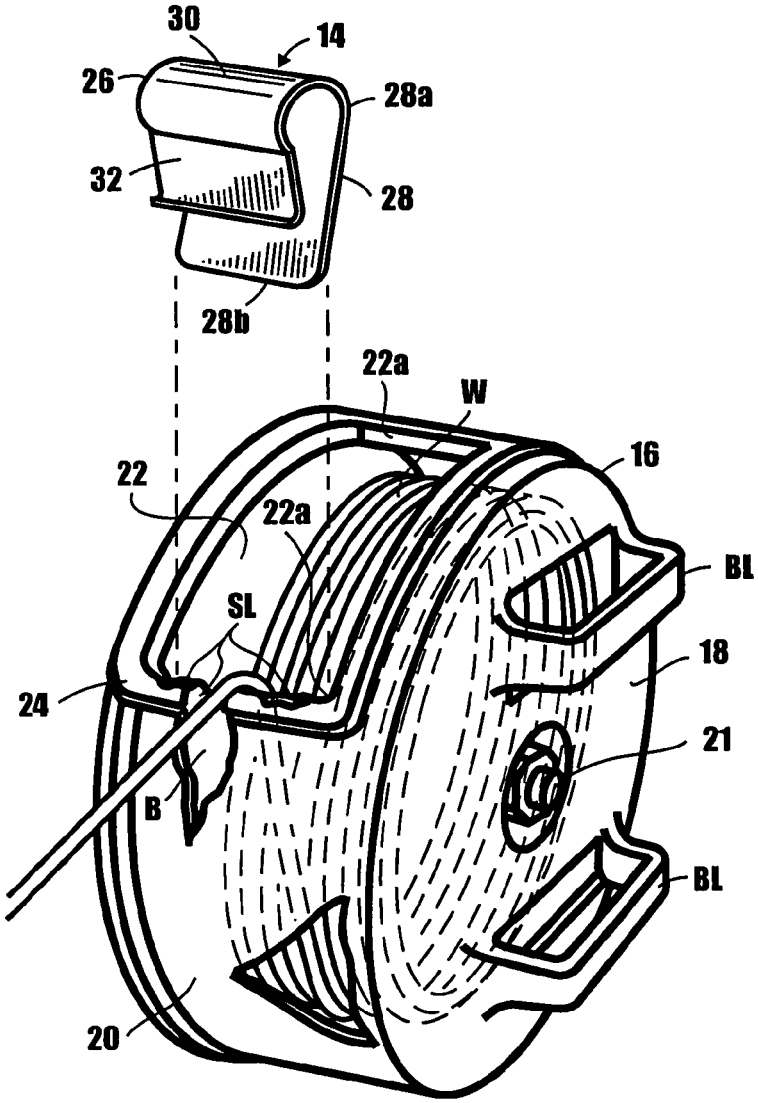
FIG. 1 is a generally perspective view of one form of prior art, tie wire dispensing reel, showing the clip of the present form of the invention exploded therefrom.
Figure 4:
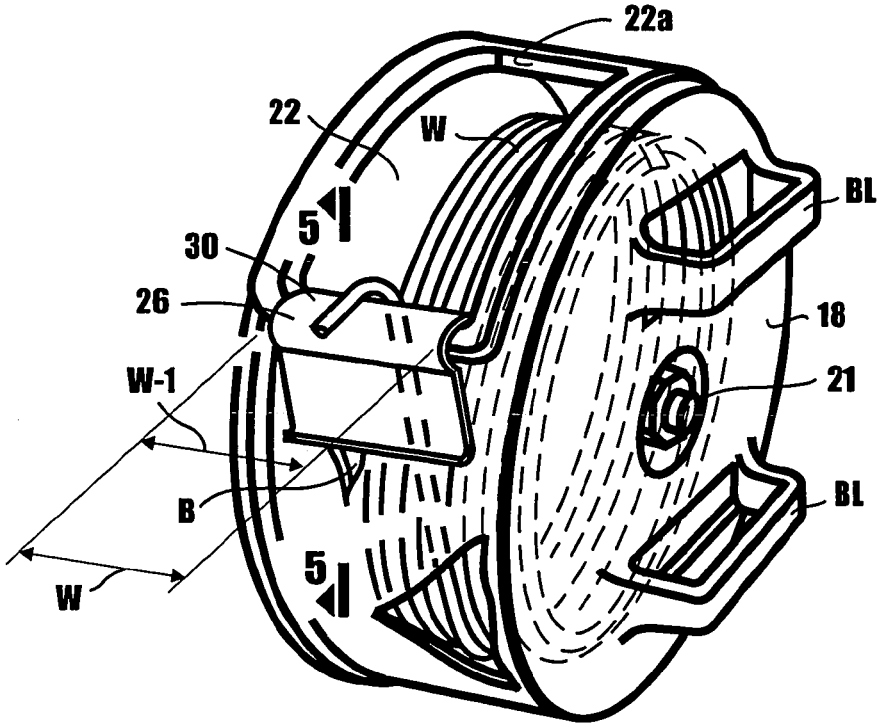
FIG. 4 is a generally perspective view of a prior art tie wire dispensing reel showing the wear surface cover clip of the invention in position over the wear surface of the wire dispensing reel.

Referring to the drawings and particularly to FIG. 1, one form of the wire dispensing device of the present invention is there shown and generally designated by 14. The wire dispensing device here comprises a hollow casing 16 having a relatively flat rear wall 18 and a forwardly projecting circular wall portion 20. A supporting shaft 21, which extends from rear wall 18 into the hollow casing 16, functions to support pre-formed coils of wire "W" (FIG. 4). Affixed to rear wall 18 are belt loops "BL" which enable the reel to be carried on the belt of the workman.

Circular wall portion 20 is provided with an opening 22 to permit withdrawal of the wire from casing 16 in the manner illustrated in FIG. 4 of the drawings. Opening 22 is provided with a curved wear surface 24 for engagement by the wire as the wire is removed from the reel.

As the tie wire is removed from the coil of wire through opening 22 of the circular wall portion 20, the tie wire engages the curved wear surface 24 causing it to score the wear surface in the manner indicated by the score lines "SL" shown in FIG. 1 of the drawings. With the passage of time, the score lines can to become deeper causing be circular wall portion 20 to ultimately breakdown in the manner shown at "B" in FIG. 1. Such a failure renders the dispensing reel substantially useless and the reel must be discarded. It is this problem that the wear surface covering clip 26 of the present invention seeks to remedy by either initially protecting the wear surface of the dispensing reel to prevent breakdown, or by repairing a defective reel in the manner shown in FIG. 4 of the drawings.

Figure 5:
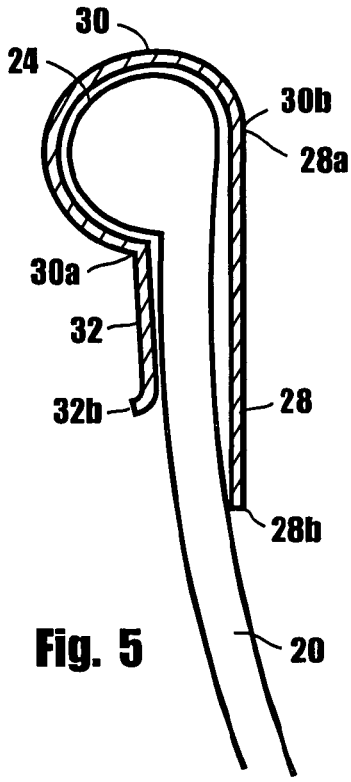
FIG. 5 is an enlarged, cross sectional view taken along lines 5-5 of FIG. 4.

As indicated in FIGS. 1, 4 and 5, the novel wear surface covering clip 26 can be readily removably connected to casing 16 to repair the defective reel. Alternatively, the clip can be removably connected to a new, unused wire dispensing reel (not shown in the drawings) so as to initially prevent damage to the wear surface 24. Additionally, it should be understood that wear surface covering clips 26 of the present invention can be used to cover either, or both, of the transversely extending edges 22*a* of the opening 22 formed in the circular wall portion of the casing.

Figure 2:
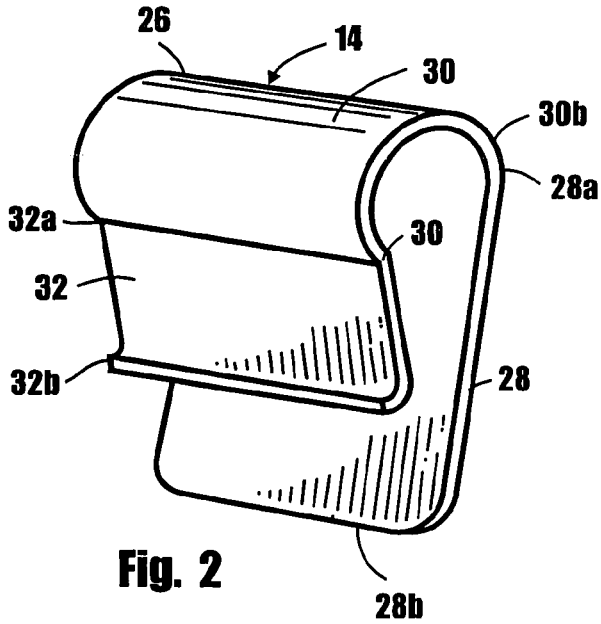
FIG. 2 is a generally perspective view of one form of the wear surface cover clip of the present invention.
Figure 3:
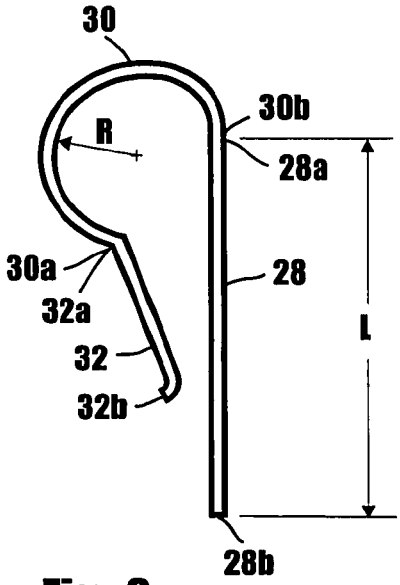
FIG. 3 is a side elevational view of the clip shown in FIG. 2.

As best seen in FIGS. 2, 3 and 5 of the drawings, clip 26, which is preferably formed from spring-type stainless steel having a very hard, abrasion resistant wear surface 30, is of a unique configuration which enables it to be quickly and easily removably interconnected with hollow casing 16 in the manner shown in FIG. 5. However, other materials such as galvanized sheet metal has proven to be satisfactory for use in constructing the clip.

In the present form of the invention, clip 26 comprises a generally planar rear segment 28, a curved wear surface cover segment 30 and a front segment 32. Rear segment 28 includes an upper extremity 28*a* and a lower extremity 28*b*. Similarly, cover segment 30 includes a front extremity 30*a* and a rear extremity 30*b* that is integrally formed with upper extremity 28*a* of rear segment 28. Front segment 32 includes an upper extremity 32*a* that is integrally formed with front extremity 30*a* of cover segment 30 and a lower extremity 32*b* that is disposed in close proximity with rear segment 28 (FIG. 3). Curved wear surface cover segment 30 is uniquely constructed so as to continuously bias the lower extremity 32*a* of front segment 32 toward rear segment 28.

To enable the clip 26 to be easily positioned over the original wear surface 24 of the hollow casing 16, the lower extremity 32*b* of front segment 32 is curved outwardly in the manner best seen in FIGS. 3 and 5. With this construction, the curved lower extremity 32*b* of the front segment will permit front segment to easily slip over the wear surface 24 and seat itself over the wear surface in the manner shown in FIG. 5. In this regard, it should be noted that the curvature of the curved wear surface cover segment 32 approximates the curvature of the dispensing reel wear surface 24 so that once the clip is snapped in place the lower portion of the cover segment will engage the lower portion of the wear surface 24 in a manner to prevent accidental removal of the clip from the wire dispenser. To this end, in the preferred form of the improvement clip, the curved wear surface cover segment has a radius "R" of between about 0.14 and about 0.18 inch.

To add further stability to the clip and to ensure that it remains in place over the wear surface of the wire dispensing reel, the length of the planar rear segment is such that it will extend a substantial distance into the hollow casing. More particularly, in the preferred form of the invention, the planar rear segment of the clip has a length "L" of approximately one inch.

As illustrated in FIG. 4, the opening 22 formed in casing 16 has a width "W" and clip 26 has a width "W-1" which is substantially equal to the width "W" of opening 22 in said housing. With this construction, when the clip 26 is in place as shown in FIG. 4, the wear surface portion of the clip, namely portion 30, will substantially cover the wear surface 24 of the wire dispensing reel so as to offer maximum protection to the wear surface 24.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A wire dispensing device comprising a casing, a supporting shaft mounted within said casing, said supporting shaft being constructed and arranged to support a preformed coil of wire, there being an opening formed in said casing to permit withdrawal of the wire from said casing, said opening having a curved wear surface for engagement by the wire as the wire is removed from said casing, the improvement comprising a wear surface covering clip removably connected to said casing, said clip comprising:

(a) a generally planar rear segment having an upper extremity and a lower extremity;

(b) a curved wear surface cover segment having a front extremity and a rear extremity connected to said upper extremity of said rear segment; and (c) a front segment having an upper extremity connected to said front extremity of said curved wear surface cover segment and a lower extremity disposed in close proximity with said rear segment, said curved wear surface cover segment being so constructed and arranged to continuously bias said lower extremity of said front segment toward said rear segment.

2. The wire dispensing device as defined in claim 1 in which said front segment includes a generally planar portion and a curved portion extending outwardly from said generally planar portion.

3. The wire dispensing device as defined in claim 1 in which said clip is constructed from spring steel.

4. The wire dispensing device as defined in claim 1 in which said clip is constructed from stainless steel.

5. The wire dispensing device as defined in claim 1 in which said curved wear surface cover segment has a radius of between about 0.14 and about 0.18 inch.

6. The wire dispensing device as defined in claim 1 in which said generally planar rear segment of said clip has a length of approximately 1 inch.

7. A wire dispensing device comprising a casing, a supporting shaft mounted within said casing, said supporting shaft being constructed and arranged to support a preformed coil of wire, there being an opening formed in said casing to permit withdrawal of the wire from said casing, said opening having a curved wear surface for engagement by the wire as the wire is removed from said casing, the improvement comprising a stainless steel wear surface covering clip removably connected to said casing, said clip comprising:

(a) a generally planar rear segment having an upper extremity and a lower extremity;

(b) a curved wear surface cover segment having a front extremity and a rear extremity connected to said upper extremity of said rear segment; and (c) a front segment having an upper extremity connected to said front extremity of said curved wear surface cover segment and an outwardly curved lower extremity disposed in close proximity with said rear segment, said curved wear surface cover segment being so constructed and arranged to continuously bias said lower extremity of said front segment toward said rear segment.

8. The wire dispensing device as defined in claim 7 in which said curved wear surface cover segment has a radius of between about 0.14 and about 0.18 inch.

9. The wire dispensing device as defined in claim 7 in which said generally planar rear segment of said clip has a length of approximately 1 inch.

10. The wire dispensing device as defined in claim 7 in which said curved wear surface cover segment has a radius of between about 0.16 and about 0.17 inch.

11. A wear surface cover for covering the wear surface of a wire reel of the character used for dispensing rebar wire and having a curved inner casing wall, said wear surface cover comprising:

(a) a generally planar rear segment having an upper extremity and a lower extremity;

(b) a curved wear surface cover segment having a front extremity and a rear extremity connected to said upper extremity of said rear segment; and (c) a front segment disposed in close proximity with said rear segment and having an upper extremity connected to said front extremity of said curved wear surface segment and a lower segment, said front segment been yieldably deformable relative to said front segment to enable the casing wall of said wire reel to be received between said front and rear segments when said wear surface cover covers said wear surface of said wire reel.

12. The wear surface cover as defined in claim 11 in which said front segment includes a generally planar portion and a curved portion extending outwardly from said generally planar portion.

13. The wear surface cover as defined in claim 11 in which said wear surface cover is constructed from spring steel.

14. The wear surface cover as defined in claim 11 in which said curved wear surface cover segment is constructed from abrasion resistant stainless steel.

15. The wear surface cover as defined in claim 11 in which said curved wear surface cover segment has a radius of between about 0.14 and about 0.18 inch.

16. The wear surface cover as defined in claim 11 in which said generally planar rear segment of said cover has a length of approximately 1 inch.

* * * * *